US008018352B2

(12) United States Patent
Shillman et al.

(10) Patent No.: US 8,018,352 B2
(45) Date of Patent: Sep. 13, 2011

(54) VIDEO TRAFFIC MONITORING AND SIGNALING APPARATUS

(75) Inventors: Robert Shillman, Rancho Santa Fe, CA (US); David Schatz, Needham, MA (US)

(73) Assignee: Cognex Corporation, Natick, MA (US)

( * ) Notice: Subject to any disclaimer, the term of this patent is extended or adjusted under 35 U.S.C. 154(b) by 419 days.

(21) Appl. No.: 11/728,858

(22) Filed: Mar. 27, 2007

(65) Prior Publication Data

US 2008/0088478 A1 Apr. 17, 2008

Related U.S. Application Data

(60) Provisional application No. 60/786,166, filed on Mar. 27, 2006.

(51) Int. Cl.
*G08G 1/054* (2006.01)

(52) U.S. Cl. ..... 340/937; 340/907; 340/933; 340/906; 362/240; 362/236; 362/800

(58) Field of Classification Search ..... 340/937, 340/935, 934, 917, 910, 906, 907, 534, 310.11, 340/933; 348/149, E7.086; 701/117; 362/545, 362/800, 240, 236; 307/3; 382/104, 100
See application file for complete search history.

(56) References Cited

U.S. PATENT DOCUMENTS

| | | | | |
|---|---|---|---|---|
| 4,511,886 | A * | 4/1985 | Rodriguez | 340/534 |
| 4,847,772 | A * | 7/1989 | Michalopoulos et al. | 701/117 |
| 5,774,569 | A * | 6/1998 | Waldenmaier | 382/100 |
| 6,466,260 | B1 | 10/2002 | Hatae et al. | |
| 6,672,745 | B1 * | 1/2004 | Bauer et al. | 362/545 |
| 2006/0017324 | A1 * | 1/2006 | Pace et al. | 307/3 |
| 2007/0001871 | A1 * | 1/2007 | Pfleging et al. | 340/907 |

FOREIGN PATENT DOCUMENTS

| | | |
|---|---|---|
| DE | 4343338 | 6/1995 |
| DE | 10014958 | 10/2001 |
| WO | 03009252 | 1/2003 |

OTHER PUBLICATIONS

PCT Search Report, WO 27126874, Dec. 6, 2007.

* cited by examiner

*Primary Examiner* — George Bugg
*Assistant Examiner* — Sisay Yacob
(74) *Attorney, Agent, or Firm* — Michael A. Jaskolski

(57) ABSTRACT

A traffic signal head having a signal lamp or signal ball with an embedded video monitoring system can be provided to perform vehicle detection to inform an intelligent traffic control system. Video monitoring of traffic lanes facing the signal head can be analyzed by such a system to emulate inductive loop signals that are input signals to traffic control systems.

27 Claims, 3 Drawing Sheets

VIDEO TRAFFIC MONITORING AND SIGNALING APPARATUS

CROSS-REFERENCE TO RELATED APPLICATIONS

The present application claims the benefit of U.S. Provisional Patent Application Ser. No. 60/786,166, which was filed on Mar. 27, 2006, by David Schatz and Robert Shillman for a VIDEO TRAFFIC MONITORING AND SIGNALING APPARATUS and is hereby incorporated by reference.

BACKGROUND OF THE INVENTION

1. Field of the Invention

The present invention relates generally to the application of vision monitoring in traffic control systems, and specifically toward a system having a video monitoring system integrated within a traffic signal lamp.

2. Background Information

Efficient and effective traffic signaling systems are essential to meet the reliance on vehicular transportation that growing urban centers demand. Traffic signaling systems are effective when they accurately detect vehicle queues at intersections, and control traffic signals in response to the queues while maintaining vehicular throughput on the main routes.

A typical traffic signaling system is composed of a signal head, with three signal lamps (Green, Yellow, Red) in each vehicle approach direction. Signal lamp activation for each signal head in an approach direction is determined and controlled by a controller, typically housed in a control box at or near the signaled intersection. Rudimentary signaling systems employ fixed, or manually varied, timers that continuously cycle the signal lamps at the intersection based on time, irrespective of the presence or absence of vehicles at those intersections.

Traffic signaling systems with adaptive cycle timing are necessary in high vehicular throughput intersections. These systems use vehicle detection methods to trigger a signal cycle upon the detection of a vehicle queue in a stopped lane. The most common vehicle detection mechanism is an inductive loop embedded in the roadway surface that provides a vehicle detection signal to the traffic signal controller. Sequential inductive loop mechanisms are necessary to provide quantitative information on vehicle queues.

Inductive loop mechanisms are expensive to install, since the roadway surface must be cut, and wire conductors must be inserted into the roadway surface, and routed to the traffic signal control box. The inductive loop mechanisms are prone to failure, and, in the event of such a failure, the controller must resort to a default mode in which it cycles based on a timer.

A more modem method of controlling traffic signals is called "video traffic monitoring systems." In this method, a vision system provides a computerized analysis of the traffic by analyzing the real-time video signal at the intersection. Video traffic monitoring system and methods employ the use of a video camera, coupled to an image processing apparatus, to detect one or more vehicles approaching the intersection. These video traffic monitoring systems can detect a single vehicle in an approach lane, or detect multiple vehicles in one or more approach lanes, and provide input that describes the queue to the traffic signal controller.

Typical video traffic monitoring systems are installed on dedicated posts at the sides of intersections, or as additional equipment on top of a signal head, or on the structure supporting the signal heads in the intersection. These video monitoring systems are costly to install due to the additional equipment, installation and the additional wiring and power requirements. Therefore, a more cost-effective method is to integrate the video traffic monitoring system directly into the traffic signaling lamp.

SUMMARY OF THE INVENTION

The system of the present invention provides an integrated system for traffic signaling and monitoring that is easy to install or retrofit using commonly used wiring and enclosures. In accordance with an illustrative embodiment, one or more lamps in a traffic signal head may be modified to include an embedded video monitoring system. An illustrative embedded video monitoring system including an image sensor, an image processor and a communications module, all installed behind the signal lamp itself. The signal lamp illustratively comprises of an array of light-emitting diodes (LEDs) that are physically arranged around a small circular area in the center that is left open so that the image sensor has a clear and unobstructed view of the intersection. The video monitoring systems analyzes the scene and then communicates its results to the control module by any of a variety of methods, including via frequency shift keying modulation over the power line. The control module then causes appropriate changes in the illumination of the lamps, i.e., to invoke a change in the traffic light status, e.g., from Red to Green, etc.

BRIEF DESCRIPTION OF THE DRAWINGS

The above and further advantages of the invention may be better understood by referring to the following description in conjunction with the accompanying drawings in which like reference numerals indicate identical or functionally similar elements.

DETAILED DESCRIPTION OF AN ILLUSTRATIVE EMBODIMENT

Figure 1:
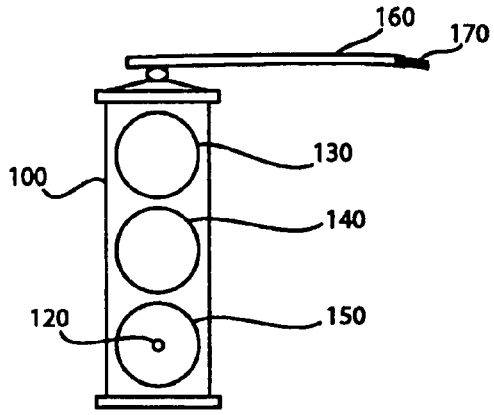
FIG. 1 is a representation of exemplary video traffic monitoring and signaling apparatus according to an illustrative embodiment of the present invention.

FIG. 1 depicts a video traffic monitoring and signaling apparatus according to an illustrative embodiment of the present invention. A traffic signal head 100 is shown suspended from a support 160, above an intersection. The signal head 100 is shown in a typical configuration with a red lamp 130, a yellow lamp 140 and a green lamp 150. The green lamp 150 is shown with an embedded video traffic monitor 120. A wiring harness 170, shown in cut-away, includes at least one wire for each lamp and a common neutral wire.

The embedded video monitoring system 120 can be installed in any of the signal lamps in the signal head 100. However, to minimize blooming effects of signaling illumination, it may be preferred that the embedded system 120 be installed in the green lamp, since the vehicle detection is most critical during the red illumination cycle for the detected traffic lane. One skilled in the art will appreciate that alternate modes of operation may warrant the installation of the embedded video monitoring in any one or more of the signal lamps, and that a band reject filter corresponding to the wavelength of the signal illumination in the chosen lamp be used to minimize the detrimental effects of the signaling illumination.

Typical traffic signal lamps emit signaling illumination by the activation of incandescent bulbs, or more recently of light emitting diode (LED) arrays. Signal heads that were originally manufactured with incandescent bulbs can be retrofitted with LED array illuminators. The lamps are typically referred to as "balls" and in the United States, and they are most commonly provided in eight and twelve-inch diameter sizes.

Figure 2:
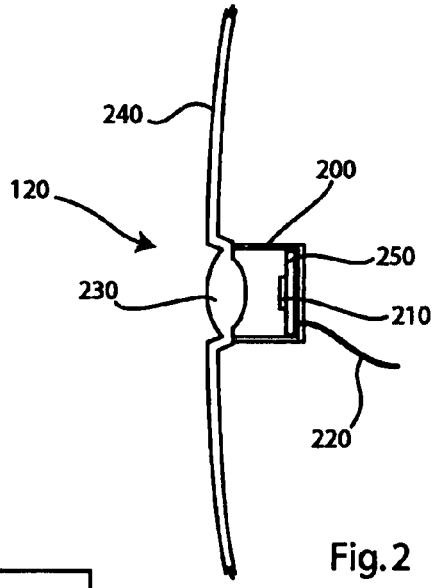
FIG. 2 is a cross-sectional view of an exemplary image sensor and lens in accordance with an illustrative embodiment of the present invention.

FIG. 2 depicts a cross-section view of a portion of the embedded video traffic monitor 120. The ball lens 240 is manufactured, or retrofitted, to incorporate a lens 230 with a camera housing 200 attached thereto. The camera housing 200 has a camera board 250 with an image sensor 210 mounted thereon. Any image sensor (e.g., CCD or CMOS) can be used, and the resolution of the sensor, combined with the optical parameters of the lens 230 operate in cooperation to provide an image of the field of view. When embedded in any of the signal lamps, the embedded video traffic monitor 120 will provide an image of the traffic lanes facing the signal head 100. In an illustrative embodiment, the optical parameters of the lens 230 and the resolution of the image sensor 210 should be sufficient to provide an image of a vehicle license plate that can be decoded using optical character recognition (OCR) algorithms for security and for red light violation detection and enforcement. A camera interface cable 220 provides power to the camera board 250, and provides an image data output in either digital or analog form.

An optional feature of the portion of the embedded system described in FIG. 2 can be additional LED illuminators (not shown) that project the same color illumination as the signal light from within the camera housing 200, so that when viewed from the traffic lanes facing the signal head, a dark or blank spot at the location of the embedded system is not apparent.

Figure 3:
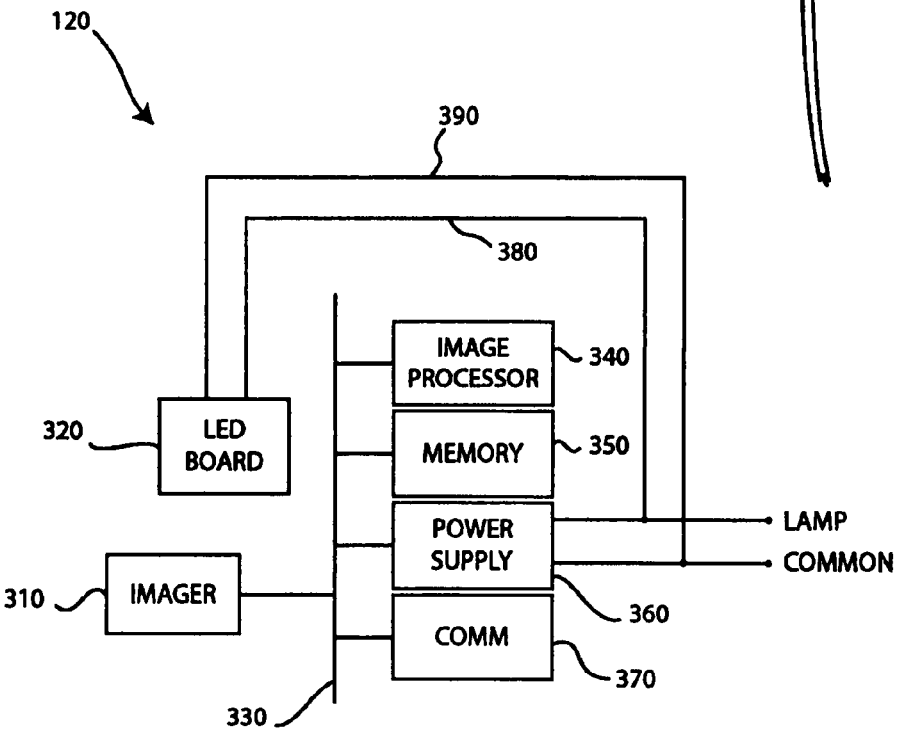
FIG. 3 is a block diagram of an exemplary video monitoring system according to an illustrative embodiment of the present invention.

FIG. 3 depicts a functional block diagram of an illustrative embodiment of the embedded video monitoring system of the present invention. In this embodiment, the signal lamp, or ball, provides the housing for the embedded video monitoring system, that can be installed in any standard signal head 100. Specifically, the system has an LED illumination board 320 that is powered by a 120 VAC or 12 VAC power applied to the lamp line 380 and the common line 390.

As shown in FIG. 3, the embedded video monitoring system 120 may include an image processor 340, a memory 350, a power supply 360, a communications module 370, an image sensor 310, and a communications bus 330 that couples these elements together and allows for cooperation and communication among those elements. These elements may be implemented as discrete components or integrated together, for example, by combining an image processor, image memory, and image sensor onto the same semiconductor or into the same electronics package.

The memory 350 may be preferably implemented with sufficient quantity of Random Access Memory (RAM), for example, 128 to 256 megabytes (MB). The image processor 340 may be a Digital Signal Processor (DSP) with sufficient executable program instructions stored in the memory 350 to perform image analysis functions. One skilled in the art of video traffic monitoring systems will appreciate the various types of image process and image analysis software that can be employed to perform the function of the image processor 340.

The image sensor 310 provides an image signal comprising a digital or analog representation of the traffic lanes facing the signal head 100, and can be provided by the portion of the embedded video traffic monitor 120 described above with reference to FIG. 2. The image signal is transmitted to the memory 350 for operation by the image processor 340 via the communications bus 330.

The power supply 360 converts and stores the line power applied to the signal lamp or ball via lamp line 380 and the common line 390, to provide typically 5 VDC to the image processor 340, memory 350, image sensor 310, and communications module 370. Due to the cyclical application of power to the signal lamp or ball, the power supply 360 must provide power storage, e.g., by way of a battery or capacitive storage devices. In an illustrative embodiment of the invention, the embedded video monitoring system 120 will operate only when the signal lamp is not energized (i.e., when another lamp in the signal head is energized). To maintain the retrofit compatibility with conventional signal heads, and to avoid additional wiring installation and maintenance expenses, the power storage function must be provided from within the embedded system in the signal lamp or ball.

The communications module 370 receives a signal from the image processor 340 via the communications bus 330 that a vehicle is detected in the vehicle lanes facing the signal head 100. The communications module 370 transmits this signal over the lamp line 380 and the common line 390 in communication with the power supply 360. The communications module 370 transmits information using a modulated signal that is overlaid on the alternating current power applied to the lamp. The communications can be bidirectional, so that setup and configuration information can be received by the communications module 370 using a similar modulated signal. In an illustrative embodiment of the invention, the signal can be transmitted using frequency shift key (FSK) modulation methods. The vehicle presence signal is a binary state that can be represented by activating a carrier signal in a narrow band above where most line noise occurs (e.g., 100/106.5 KHz and 150/156.5 KHz frequency pairs).

In an alternative embodiment, the communications module 370 can transmit the vehicle presence signal wirelessly using conventional wireless communication standards.

Figure 4:
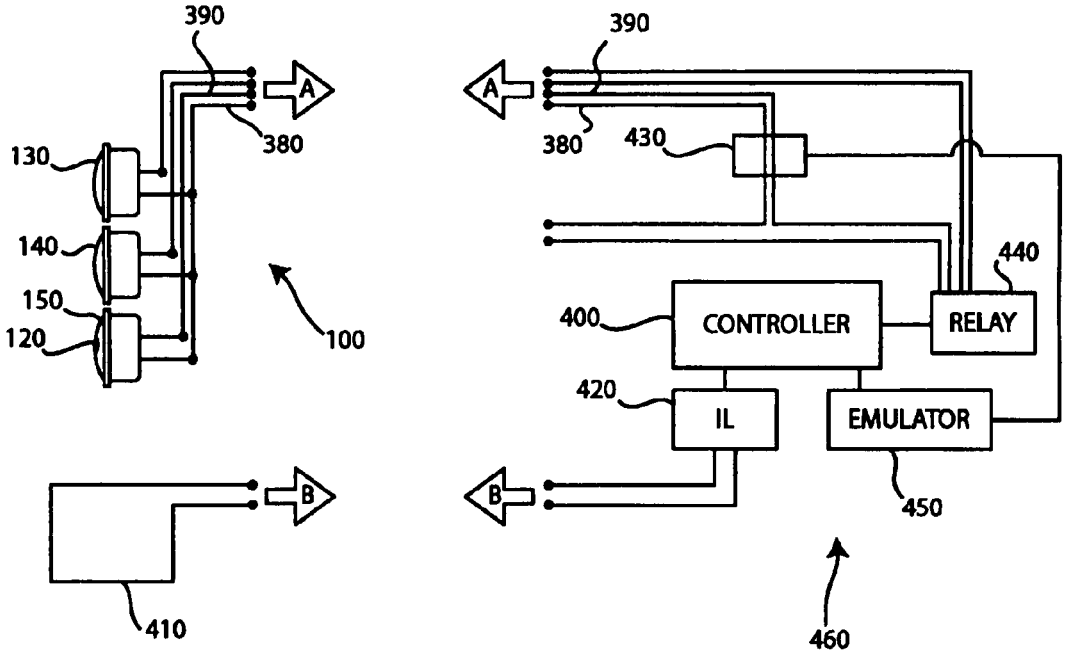
FIG. 4 is a schematic diagram of an exemplary video monitoring system according to an illustrative embodiment of the present invention.

FIG. 4 depicts a schematic diagram of the integration of the embedded video monitoring system into a typical traffic signal control system 460 according to an illustrative embodiment of the present invention.

The signal head 100, previously described, is illustratively shown with a red lamp 130, a yellow lamp 140, and a green lamp 150 having an embedded video system monitor 120. A lamp line is provided to each of the respective lamps, including the lamp line, and each lamp is commonly coupled to the common line 380. The respective lamp lines and the common line 380 are coupled to the control system 460 as depicted by reference arrow indicators (A).

An inductive loop 410 is shown, that is typically installed in a travel lane facing a signal head. The embedded video system monitor of the present invention replaces the need for the inductive loop signaling, but is shown here to assist in describing the manner in which the present invention may be illustratively integrated into existing control systems. The inductive loop is embedded into the asphalt road surface, and would be coupled to the control system 460 as depicted by reference arrow indicators (B). In the control system 460, which is typically installed in a housing or cabinet at or near the traffic intersection, the inductive loop signal is coupled to an inductive loop module 420 that translates the inductive loop signal into a binary signal that is directed into the signal controller 400.

When operating in response to an inductive loop signal, the controller 400 will activate a relay 440 that applies power to the appropriate lamp line in a timed sequence, including the green lamp line 390.

As shown in FIG. 4, a communications control module 430 is coupled to the common line 380 and the green lamp line 390, to receive the signal transmitted from the communications module 370 of the embedded video monitoring system 120. The communications control module 430 operates in the same manner as the communications module 370 in the embedded video monitoring system 120, in that it detects the carrier signals overlaid upon the power applied to the line, regardless of whether the power is applied to the line or not (since it is downstream from the relay 440). The communications control module 430 outputs a signal representative of the signal transmitted to indicate the presence of a vehicle in the traffic lanes facing the signal head 100 to an emulator 450.

The emulator 450, shown in FIG. 4 translates the vehicle detection signal from the embedded video monitoring system into a binary signal like that emitted from the inductive loop module 430, so that the video system of the present invention can be integrated into existing traffic control systems. The emulator 450 is coupled to the inductive loop input for the traffic lanes facing the signal head 100 housing the embedded video monitoring system 120, and thus, effectively replaces the inductive loop functionality.

Configuration of the embedded video monitoring system 120 can be performed using a programming interface, such as a notebook computer, or a suitable computing device having a display monitor and input device such as a keyboard and/or a mouse. Alternatively, the programming interface can be an RS 170 monitor and a keyboard, with all programming and configuration software executing on the image processor. The programming interface can be directly connected to the communications controller module 430, or wirelessly connected using standard wireless communications protocol. Configuration may include training the software algorithms running in the image processor 340 to recognize the extent of the traffic lanes upon which vehicles are detected. One skilled in the art of video traffic monitoring devices can appreciate the various ways that one can train or teach such a system to detect vehicles.

Configuration and setup functions may require the transmission of sample images from the embedded video monitoring system to the programming interface. Using the same data transmission methods provided for transmitting the vehicle detection 'signal from the embedded system to the controller, an image signal can be transmitted. Similarly, in order to transmit the programming instructions from the programming" interface to the embedded video monitoring system the same transmission methods can be employed In some implementations, it is contemplated that the signal head 100 may be installed by suspension from a support cable or wire that may result in wind-induced swinging or swaying. To compensate for this movement, the algorithms used to detect vehicle presence can track stationary objects in the field of view or incorporate information from mechanical or optical position or angular rate sensors, or by a combination of such techniques.

Figure 5:
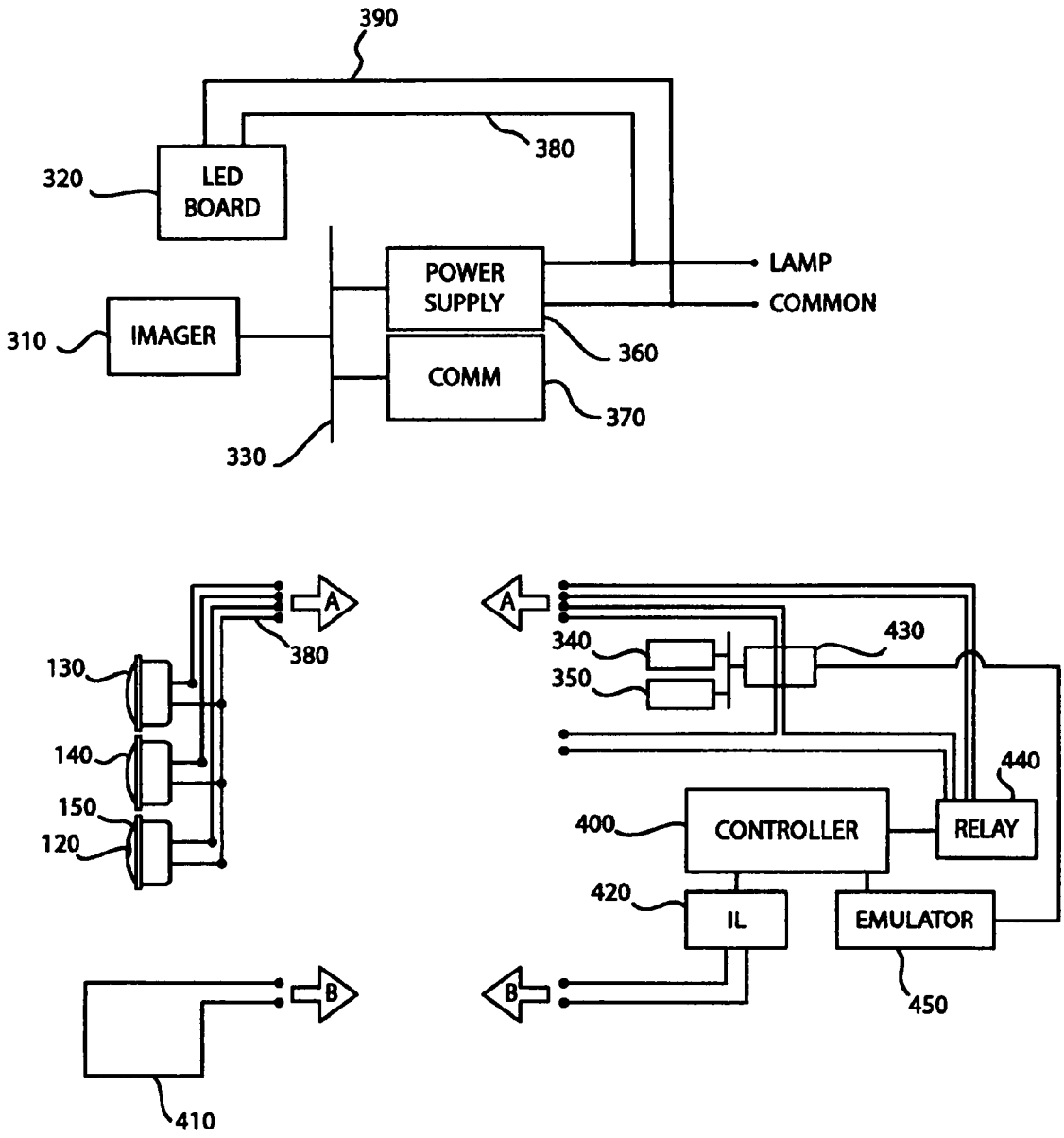
FIG. 5 is a schematic diagram of an exemplary video monitoring system according to illustrative embodiment of the present invention.

FIG. 5 depicts an alternate embodiment of the present invention wherein the embedded video monitoring system is partially housed in the signal lamp or ball, and the remaining portion is housed in the controller cabinet. In this embodiment, the cost of the replaceable signal lamp or ball component is reduced, though the initial installation effort is slightly increased.

As shown in FIG. 5, the image sensor 310 outputs a digital or analog image signal onto the communications bus 330 that is transmitted through the communications module 370 as a signal overlaid upon the power lines. The communications control module 430 is coupled to the memory 350 and the image processor 340, for receiving and analyzing the transmitted image. The communications control module 430 outputs a signal representative of the signal transmitted to indicate the presence of a vehicle in the traffic lanes facing the signal head 100 to the emulator 450.

The emulator 450, shown in FIG. 5 translates the vehicle detection signal from the embedded video monitoring system into a binary signal like that emitted from the inductive loop module 430, so that the video system of the present invention can be integrated into existing traffic control systems. The emulator 450 is couple to the inductive loop input for the traffic lanes facing the signal head 100 housing the embedded video monitoring system 120, and thus, effectively replaces the inductive loop functionality.

The present invention has been described with the use of a frequency shift keying mode of data transmission overlaid upon power lines that interconnect the signal lamp 100 to the control panel. One skilled in the art will appreciate that alternative modes of communications can be provided, such as wireless protocols. It is expressly contemplated that FM radio signals can be used to transmit a vehicle detection signal from the embedded vision monitoring system to the control panel where an inductive loop signal is emulated. Furthermore, additional wireless communications modes, such 802.11a, b, or g protocols utilizing standard encryption methods can be employed.

The present invention can be deployed in detecting and enforcing red light infraction incidents. When a vehicle is detected in the traffic lanes facing the signal head having the embedded video monitoring system 120, sequential analysis of multiple frames of acquired images can monitor and track the motion of the detected vehicle. If the vehicle is determined to have entered the intersection during a red light cycle for the monitored traffic lanes, a previously acquired frame of that vehicle that displays the license plate, along with a number of frames showing the vehicle entering the intersection, can be retained for subsequent analysis to report and/or enforce a traffic citation on the owner of the vehicle.

The present invention can be deployed to detect and report emergency strobe light flashes, so that the traffic signaling can be pre-empted to provide priority to the emergency vehicle. The sensing of the emergency strobe by the present invention can be accomplished by measuring the flash frequency and/or color of the strobe.

The present invention can be deployed to store, or transmit for storage, images of the traffic lanes facing the signal head for security and forensic purposes. Real-time feed of acquired images can be buffered in the memory module 350 of the embedded video monitoring system, and transmitted of a central server, or other storage device, on demand. The recorded images can be subsequently analyzed in the event of an accident, or security event.

Other modifications and implementations will occur to those skilled in the art without departing from the scope of the invention as claimed. Accordingly, the above description is intended to be words of description, rather than limitations of the invention.

What is claimed is:

1. A system for traffic monitoring and signaling, wherein a conventional signal lamp includes a housing and a light source located within a space formed by the housing, the system comprising:

a traffic signal head having at least one lamps receiving space that is open to one side, the lamp receiving space configured to receive a conventional signal lamp; and a signal lamp comprising a video traffic monitoring system and a light source, the video traffic monitoring system comprising an image sensor configured to provide an image of one or more traffic lanes facing the signal head; and wherein the signal lamp including the video traffic monitoring system is received within the lamps space.

2. The system of claim 1 wherein the video traffic monitoring system further comprises a lens operatively interconnected with the image sensor, the lens having optical parameters to enable the image sensor to capture an image of a vehicle license plate.

3. The system of claim 1 wherein the video traffic monitoring system further comprises of an image processor configured to perform image analysis.

4. The system of claim 1 further comprising a communications module configured to transmit information from the video traffic monitoring system to a control module.

5. The system of claim 4 wherein the information comprises an indicator of whether a vehicle is present in one or more of the one or more traffic lanes.

6. The system of claim 5 wherein the indicator is identical to a signal output by an inductive loop detector.

7. The system of claim 4 wherein the information is transmitted using a signal overlaid onto a power line to the signal lamps.

8. The system of claim 4 wherein the information is transmitted using frequency shift keying modulation.

9. The system of claim 4 wherein the information is transmitted using frequency modulation radio signals.

10. The system of claim 4 wherein the system includes more than one signal lamp and wherein the control module is configured to, in response to receipt of information from the video traffic monitoring system, activate one of the one or more lamps.

11. The system of claim 1 wherein the video traffic monitoring system is further configured to detect emergency strobe lights.

12. The system of claim 11 wherein the image sensor is further configured to differentiate among differing colors of emergency strobe lights.

13. The system of claim 1 wherein the video traffic monitoring system is further configured to retain one or more images of one or more of the one or more traffic lanes.

14. The system of claim 13 wherein the one or more images are stored in a central server.

15. The system of claim 1 wherein the signal lamp incorporating the video traffic monitoring system ace is mechanically swappable with conventional traffic signal lamps.

16. The system of claim 1 wherein the lamp that includes the video traffic monitoring system includes a lamp lens that substantially closes the open side of the lamp receiving space, the image sensor arranged to obtain images through the lamp lens.

17. The system of claim 16 wherein the lamp lens includes a second lens incorporated therein, the second lens operatively aligned with the image sensor and having optical parameters to enable the image sensor to capture an image of a vehicle license plate.

18. The system of claim 1 wherein the signal lamp further comprises a lamp housing forming a housing space and wherein the video traffic monitoring system and light source are located within the housing space.

19. The system of claim 1 wherein the traffic signal head wherein the lamp receiving space is a first lamp receiving space and the traffic signal head further includes a second lamp receiving space substantially similar to the first lamp receiving space and the system includes a conventional signal lamp that includes a light source located within a lamp housing wherein the lamp housing is received within the second lamp receiving space.

20. The system of claim 1 wherein the signal lamp including the video traffic monitoring system includes a lamp housing that is substantially similar to the housing of a conventional signal lamp.

21. A system for traffic monitoring and signaling, the system comprising:

a traffic signal head having at least first and second substantially similar lamp receiving spaces that are each open to one side;

a first signal lamp comprising a first housing, a first lens, a video traffic monitoring system and a first light source, the video traffic monitoring system comprising an image sensor configured to provide an image of one or more traffic lanes facing the signal head, the first light source and video traffic monitoring system located within a space defined by the first housing and the first lens;

a conventional signal lamp comprising a second housing, a second lens and a second light source wherein the second light source is located within a space defined by the second housing and the second lens;

wherein each of the first and second housings includes an external surface and each of the external surfaces is substantially identical and each housing is received in one of the first and second lamp receiving spaces with the lenses substantially closing the lamp receiving space openings.

22. A system for traffic monitoring and signaling, the system comprising:

a traffic signal head having first, second and third substantially similar lamp receiving spaces that are each open to one side;

first, second and third signal lamps receives within the first, second and third lamp receiving spaces, each signal lamp including a light source located within a housing wherein each of the housings includes an external surface and each of the external surfaces is substantially identical; and a video traffic monitoring system located within one of the signal lamp housings, the video traffic monitoring system comprising an image sensor configured to provide an image of one or more traffic lanes facing the signal head.

23. The system of claim 16 wherein the lamp lens includes a second lens incorporated therein, the second lens operatively aligned with the image sensor and having optical parameters to enable the image sensor to capture the image of one or more traffic lanes facing the signal head through the second lens.

24. The system of claim 23 further comprising a second light source, the second light source configured to project illumination onto the second lens so as to illuminate the second lens.

25. The system of claim 1 further comprising a power supply, the power supply configured to provide power to the video traffic monitoring system when the light source is not energized.

26. A system for traffic monitoring and signaling, wherein a traffic signal head includes at least one lamp receiving space that is open to one side, the lamp receiving space configured to receive a conventional signal lamp, the conventional signal lamp including a housing and a light source located within a space formed by the housing, the system comprising:

a signal lamp comprising a video traffic monitoring system and a light source, the video traffic monitoring system comprising an image sensor configured to provide an image of one or more traffic lanes facing the signal head;

a signal lamp housing including an open side, the video traffic monitoring system and the light source being positioned within the signal lamp housing;

a lamp lens that substantially closes the open side of the signal lamp housing, the image sensor arranged to obtain the image of the one or more traffic lanes through the lamp lens; and wherein the signal lamp housing, including the video traffic monitoring system and the light source, is mechanically swappable with the conventional signal lamp.

27. A method for traffic monitoring, wherein a conventional signal lamp includes a housing and a light source located within a signal lamp space in a traffic signal head, the method comprising:

providing a signal lamp comprising a video traffic monitoring system and a light source, the video traffic monitoring system comprising an image sensor configured to provide an image of one or more traffic lanes facing the signal head, the signal lamp including the video traffic monitoring system and the light source configured to be received within the space configured for the conventional signal lamp;

detecting, by the image sensor, one or more vehicles in one or more lanes facing the traffic signal head; and transmitting an indicator of whether a vehicle is present in the one or more lanes.

* * * * *